US008731805B2

(12) United States Patent
Bungo

(10) Patent No.: US 8,731,805 B2
(45) Date of Patent: May 20, 2014

(54) IGNITION CONTROL APPARATUS FOR GENERAL-PURPOSE ENGINE

(75) Inventor: Keiichiro Bungo, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 1104 days.

(21) Appl. No.: 12/722,991

(22) Filed: Mar. 12, 2010

(65) Prior Publication Data

US 2010/0263628 A1 Oct. 21, 2010

(30) Foreign Application Priority Data

Apr. 20, 2009 (JP) ..... 2009-101624

(51) Int. Cl.
*F02P 5/06* (2006.01)
*F02P 5/15* (2006.01)
*F02D 37/02* (2006.01)

(52) U.S. Cl.
CPC ..... *F02P 5/1508* (2013.01); *F02D 37/02* (2013.01)
USPC . 701/110; 701/111; 123/339.11; 123/406.24; 123/406.59

(58) Field of Classification Search
CPC ..... F02D 37/02; F02P 5/1508
USPC ..... 701/107, 110, 111; 123/198 DC, 406.19, 123/406.23, 406.24, 406.58, 406.59, 339.11
See application file for complete search history.

(56) References Cited

U.S. PATENT DOCUMENTS

| | | | | |
|---|---|---|---|---|
| 4,870,587 | A * | 9/1989 | Kumagai | 701/110 |
| 5,613,473 | A * | 3/1997 | Angermaier | 123/481 |
| 6,457,465 | B2 * | 10/2002 | Lee | 123/643 |
| 6,550,452 | B2 * | 4/2003 | Schneider | 123/436 |
| 6,600,322 | B1 * | 7/2003 | Nussbaum | 324/380 |
| 6,874,473 | B2 * | 4/2005 | Carpenter | 123/406.18 |
| 7,886,584 | B2 * | 2/2011 | Machida et al. | 73/114.27 |

FOREIGN PATENT DOCUMENTS

| | | | |
|---|---|---|---|
| CN | 1643242 | A | 7/2005 |
| CN | 101169090 | A | 4/2008 |
| CN | 101194088 | A | 6/2008 |
| DE | 102005043129 | A1 | 3/2007 |
| EP | 0640762 | A1 | 3/1995 |
| EP | 1803916 | A1 | 7/2007 |
| JP | 08-121299 | A | 5/1996 |
| JP | 2000-018087 | A | 1/2000 |
| JP | 3582800 | B2 | 10/2004 |

OTHER PUBLICATIONS

Korean Office Action dated Nov. 10, 2011, issued in corresponding Korean Patent Application No. 10-2010-0033349. (w/partial translation).
Japanese Office Action dated Mar. 8, 2011, issued in corresponding Japanese Patent Application No. 2009-101624.
Chinese Office Action dated Jul. 25, 2011, issued in corresponding Chinese Patent Application No. 201010167471.3.
European Search Report dated Jul. 27, 2010, issued in corresponding European Patent Application No. 10157771.6.

* cited by examiner

*Primary Examiner* — Hai Huynh
(74) *Attorney, Agent, or Firm* — Westerman, Hattori, Daniels & Adrian, LLP

(57) ABSTRACT

In an apparatus for controlling ignition of a general-purpose internal combustion engine in which an ignition signal is produced both in a compression stroke and in an exhaust stroke of a four stroke cycle, one of the ignitions to be conducted based on the produced two ignition signals is cut and an after-ignition-cut engine speed is detected. Then it is discriminated whether each of the two ignition signals was produced in the compression stroke or in the exhaust stroke based on a difference between an average engine speed and the after-ignition-cut engine speed, and the ignition is controlled based on the ignition signal discriminated to be produced in the compression stroke in the two ignition signals, thereby enabling to improve the duration life of an ignition plug, with simple and compact structure.

8 Claims, 4 Drawing Sheets

IGNITION CONTROL APPARATUS FOR GENERAL-PURPOSE ENGINE

BACKGROUND OF THE INVENTION

1. Field of the Invention

This invention relates to an apparatus for and method of controlling ignition of a general-purpose internal combustion engine.

2. Description of the Related Art

Many of four-cycle general-purpose internal combustion engines are configured to produce ignition signals, in addition to in the compression stroke, also in the exhaust stroke among the intake, compression, expansion and exhaust strokes so as to simplify the structure, and based on the ignition signals, conduct the ignition. The ignition based on the ignition signal produced in the compression stroke is called a "normal ignition" because it is conducted in accordance with the combustion cycle to burn air-fuel mixture, while the ignition based on the ignition signal produced in the exhaust stroke is a "waste ignition" because it is the ignition not required and the air-fuel mixture is not burned.

Such the configuration disadvantageously shortens the duration life of an ignition plug of the engine due to the waste ignition. Since this disadvantage is caused by generation of two ignition signals per one rotation of a crankshaft, it may be configured to produce the ignition signal resulting only in the normal ignition by providing a reluctor and pulser on a camshaft whose half rotation corresponds to one rotation of the crankshaft.

Further, Japanese Patent No. 3582800 proposes a technique to use a second pulse signal produced at every unit rotation angle of the crankshaft in addition to a pulse signal produced at every rotation thereof so as to determine whether the pulse signal outputted at every rotation is produced in the compression stroke or exhaust stroke and conduct the ignition based on the pulse signal produced in the compression stroke.

SUMMARY OF THE INVENTION

However, since the above technique described first causes a camshaft portion to grow in size and complexity and the technique described secondly needs two pairs of projections and electromagnetic coils for pulse generation, the both are inadequate for a general-purpose engine which is required to be compact and simple.

An object of this invention is therefore to overcome the problem by providing an apparatus for and method of controlling ignition of a general-purpose engine that can improve the duration life of an ignition plug, with simple and compact structure.

In order to achieve the object, this invention provides in its first aspect an apparatus for controlling ignition of a general-purpose internal combustion engine in which an ignition signal is produced in a compression stroke and in an exhaust stroke of a four stroke cycle, comprising: an engine speed detector that detects a speed of the engine; an average engine speed calculator that calculates an average engine speed over a predetermine period of time based on the detected engine speed; an ignition cutter that cuts one of the ignitions to be conducted based on the produced two ignition signals; an after-ignition-cut engine speed detector that detects an after-ignition-cut engine speed after the ignition was cut; an ignition signal discriminator that discriminates whether each of the two ignition signals was produced in the compression stroke or in the exhaust stroke based on the calculated average engine speed and the after-ignition-cut engine speed; and an ignition controller that controls the ignition based on the ignition signal discriminated to be produced in the compression stroke in the two ignition signals.

In order to achieve the object, this invention provides in its second aspect a method of controlling ignition of a general-purpose internal combustion engine in which an ignition signal is produced in a compression stroke and in an exhaust stroke of a four stroke cycle, comprising the steps of: detecting a speed of the engine; calculating an average engine speed over a predetermine period of time based on the detected engine speed; cutting one of the ignitions to be conducted based on the produced two ignition signals; detecting an after-ignition-cut engine speed after the ignition was cut; discriminating whether each of the two ignition signals was produced in the compression stroke or in the exhaust stroke based on the calculated average engine speed and the after-ignition-cut engine speed; and controlling the ignition based on the ignition signal discriminated to be produced in the compression stroke in the two ignition signals.

BRIEF DESCRIPTION OF THE DRAWINGS

The above and other objects and advantages of the invention will be more apparent from the following description and drawings in which.

DETAILED DESCRIPTION OF THE PREFERRED EMBODIMENT

An apparatus for and method of controlling ignition for a general-purpose engine according to a preferred embodiment of the present invention will now be explained with reference to the attached drawings.

Figure 1:
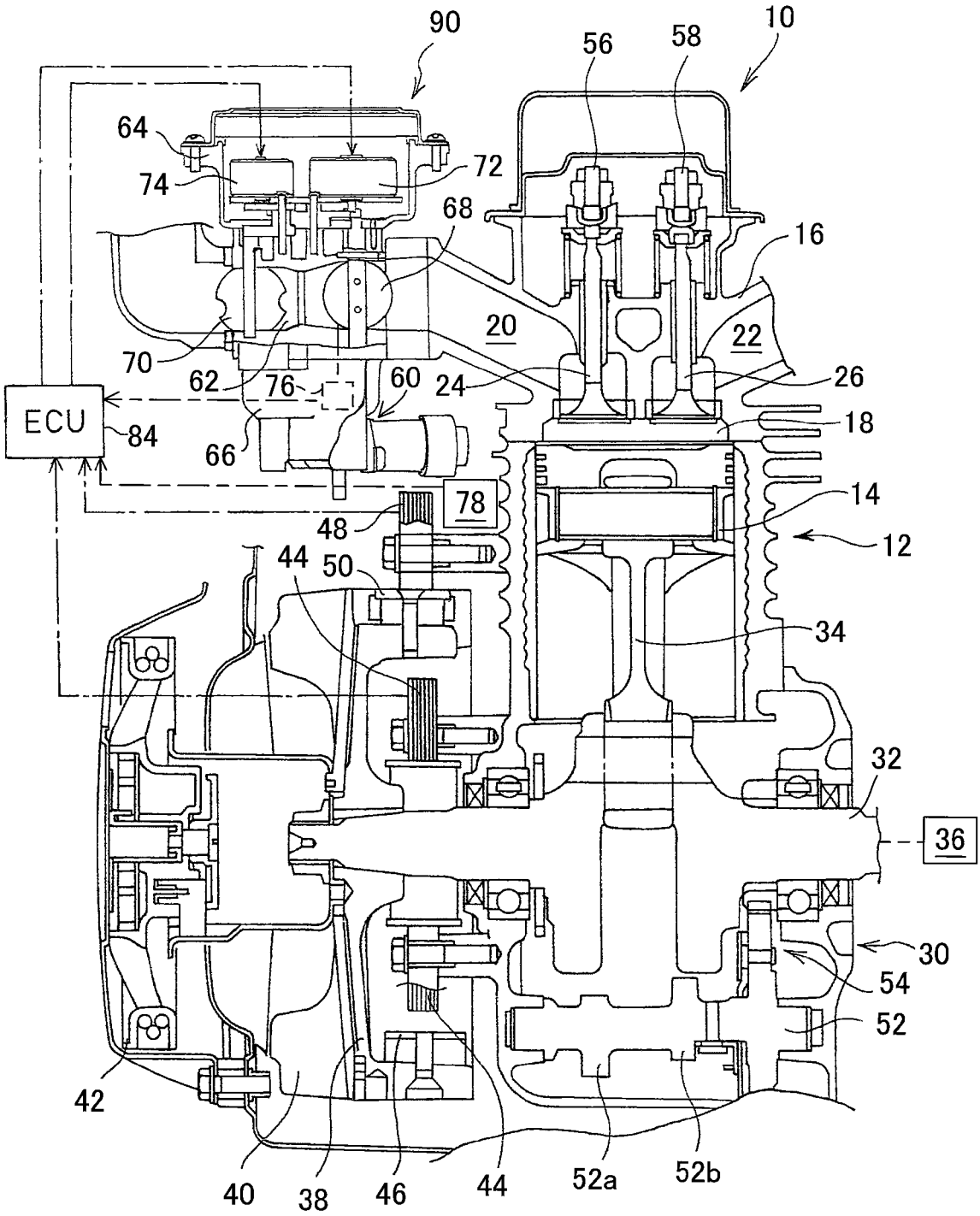
FIG. 1 is an overall view schematically showing an ignition control apparatus for a general-purpose engine according to an embodiment of this invention.

FIG. 1 is an overall view schematically showing an ignition control apparatus for a general-purpose engine according to an embodiment of this invention.

Reference numeral 10 in FIG. 1 designates a general-purpose internal combustion engine (hereinafter simply called "engine"). The engine 10 is an air-cooled, four-cycle, single-cylinder OHV model with a displacement of, for example, 440 cc, using gasoline as fuel.

The engine 10 is equipped in its cylinder block 12 with a cylinder accommodating a piston 14 that can reciprocate therein. A cylinder head 16 attached at the upper portion of the cylinder block 12 is provided with a combustion chamber 18 that faces the top of the piston 14 and with an intake port 20 and exhaust port 22 that are connected to the combustion chamber 18. An intake valve 24 and exhaust valve 26 are installed near the intake port 20 and exhaust port 22, respectively.

A crank case 30 is attached to the bottom of the cylinder block 12 and houses a crankshaft 32 to be rotatable therein. The crankshaft 32 is connected to the bottom of the piston 14 through a connecting rod 34. One end of the crankshaft 32 is connected to a load 36 so that the engine 10 outputs power to the load 36.

The other end of the crankshaft 32 is attached with a flywheel 38, cooling fan 40 and recoil starter 42 used for engine start. A power coil (generator coil) 44 is attached to the crank case 30 in the inside of the flywheel 38 and magnets (permanent magnet pieces) 46 are attached on a back surface of the flywheel 38. The power coil 44 and magnets 46 constitute a multipolar generator that produces electric power in synchronization with rotation of the crankshaft 32.

An exciter coil 48 is attached to the crank case 30 in the outside of the flywheel 38 and magnets (permanent magnet pieces) 50 are attached on a top surface of the flywheel 38. The exciter coil 48 produces an output every time the magnet 50 passes.

A camshaft 52 is rotatably housed in the crank case 30 to be parallel with the axis line of the crankshaft 32 and connected via a gear mechanism 54 to the crankshaft 32 to be driven thereby. The camshaft 52 is equipped with an intake cam 52*a* and exhaust cam 52*b* to operate the intake valve 24 and exhaust valve 26 through a push rod (not shown) and rocker arms 56, 58.

A carburetor 60 is connected to the intake port 20. The carburetor 60 unitarily comprises an air intake passage 62, motor case 64 and carburetor assembly 66. The air intake passage 62 is installed with a throttle valve 68 and a choke valve 70.

The motor case 64 houses an electric throttle motor 72 for operating the throttle valve 68 and an electric choke motor 74 for operating the choke valve 70. The throttle and choke motors 72, 74 comprise stepper motors.

The carburetor assembly 66 is supplied with fuel from a fuel tank (not shown) to produce air-fuel mixture by injecting fuel by an amount defined by the openings of the throttle valve 68 and choke valve 70 to be mixed with intake air flowing through the air intake passage 62.

The produced air-fuel mixture passes through the intake port 20 and intake valve 24 to be sucked into the combustion chamber 18 and is ignited by an ignition unit having a spark plug, ignition coil and the like, to burn. The resulting combustion gas (exhaust gas) is discharged to the exterior of the engine 10 through the exhaust valve 26, exhaust port 22, a muffler (not shown), etc.

A throttle opening sensor 76 installed near the throttle valve 68 produces an output or signal corresponding to the opening of the throttle valve 68. A temperature sensor 78 having a thermistor, etc., is installed at an appropriate position of the cylinder block 12 and produces an output or signal indicative of the temperature of the engine 10.

The outputs of the throttle opening sensor 76 and temperature sensor 78 and also outputs of the power coil 44 and exciter coil 48 are sent to an electronic control unit (ECU) 84. The ECU 84 includes a microcomputer having a CPU, ROM, memory, input/output circuits and the like.

The output (alternating current) of the power coil 44 is sent to a bridge circuit (not shown) in the ECU 84, where it is converted to direct current through full-wave rectification to be supplied as operating power to the ECU 84, throttle motor 72 or the like, and also sent to a pulse generation circuit (not shown), where it is converted to a pulse signal. The output of the exciter coil 48 is used as an ignition signal of the ignition unit. Specifically, the ignition signal is produced by the exciter coil 48 at every rotation of the crankshaft 32.

The CPU of the ECU 84 detects engine speed based on the converted pulse signal and controls the operations of the throttle motor 72 and choke motor 74 based on the detected engine speed and the outputs of the throttle opening sensor 76 and temperature sensor 78, while controlling the ignition through the ignition unit.

The explanation of the ignition control will be explained in detail.

Figure 2:
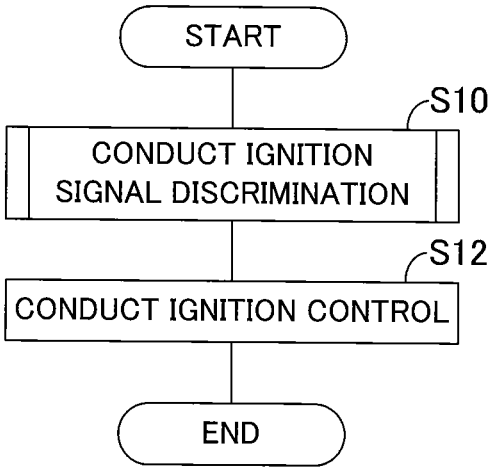
FIG. 2 is a flowchart showing the operation of the apparatus, i.e., an ignition control method shown in FIG. 1.

FIG. 2 is a flowchart showing the operation, i.e., the operation of the ignition control apparatus according to this embodiment. The illustrated program is executed upon activation of the ECU 84.

In S10, an ignition signal discrimination process is conducted.

Figure 3:
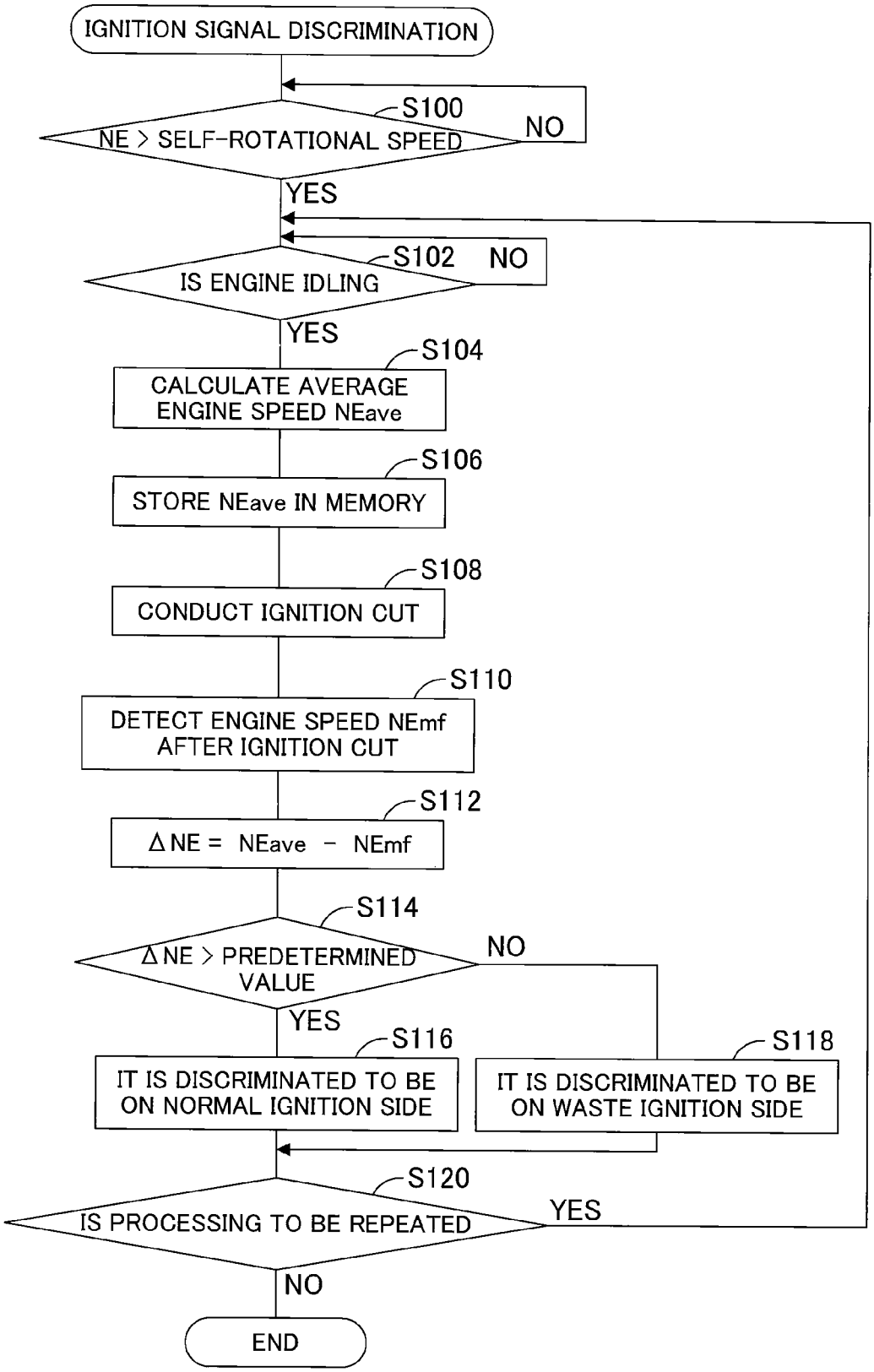
FIG. 3 is a subroutine flowchart showing an ignition signal discrimination process in FIG. 2.

FIG. 3 is a subroutine flowchart of the process.

In S100, it is determined whether the detected engine speed NE exceeds a self-rotational speed. The self-rotational speed is a value enabling to determine that the engine start by the recoil starter 42 has been completed, e.g., 800 rpm. When it is determined that the engine speed has reached the self-rotational speed, the program proceeds to S102.

In S102, it is determined whether the engine 10 is idling, i.e., the engine speed NE is at an idling speed ranging from 1400 rpm to 1600 rpm. When it is determined that the engine 10 is idling, the program proceeds to S104.

In S104, an average engine speed NEave (average value of the engine speeds) is calculated. Specifically, the average engine speed NEave is obtained by storing detected engine speeds NE over a predetermined period of time (e.g., 1 second) in the memory and calculating a simple average of the multiple engine speeds NE.

The program proceeds to S106, in which the calculated average engine speed NEave is stored in the memory.

Next, in S108, an ignition cut is conducted. The ignition signal is produced at every crankshaft rotation, so that the ignition signal of the compression stroke and that of the exhaust stroke are alternately produced. Since it is not possible to discriminate in which stroke the ignition signal was produced at this stage, an ignition based on either one of the two ignition signals is cut (stopped) only one time. The ECU 84 conducts this ignition cut by not outputting the ignition command to the ignition coil for the one of the two inputted ignition signals.

It should be noted that the ignition cut may be conducted not only one time but also times, i.e., two times.

The program then proceeds to S110, in which the engine speed after the ignition cut, i.e., an after-ignition-cut engine speed NEmf is detected. The after-ignition-cut engine speed NEmf is a value detected after a time period (set based on the average engine speed NEave) has elapsed since the ignition cut.

Next, in S112, an engine speed variation difference ΔNE representing variation of the engine speed before and after the ignition cut is calculated. The difference ΔNE is obtained by subtracting the after-ignition-cut engine speed NEmf from the average engine speed NEave.

Nest in S114 and on, an ignition signal discrimination process is conducted by comparing the difference ΔNE with a predetermined value.

Figure 4A:
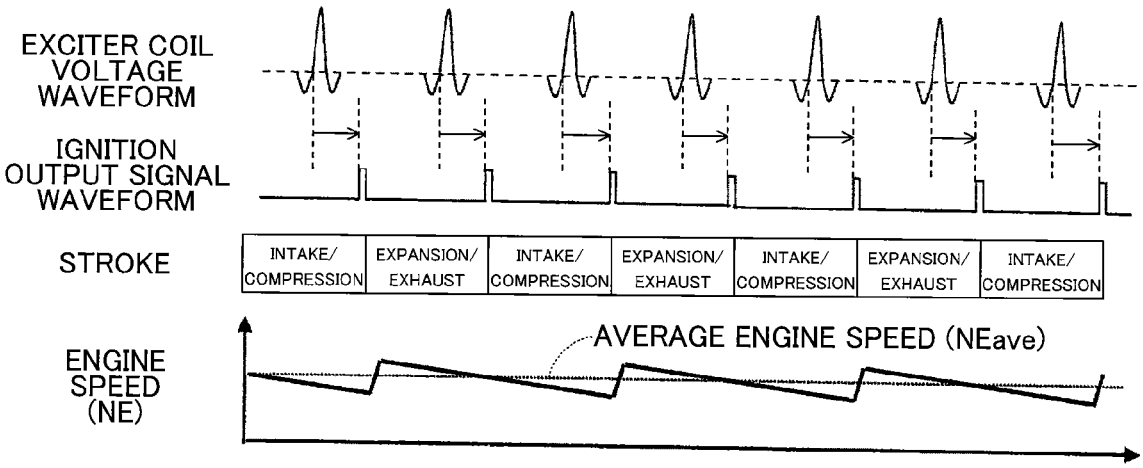
FIGS. 4A and 4B are set of explanatory views for explaining the ignition signal discrimination process of FIG. 3.
Figure 4B:
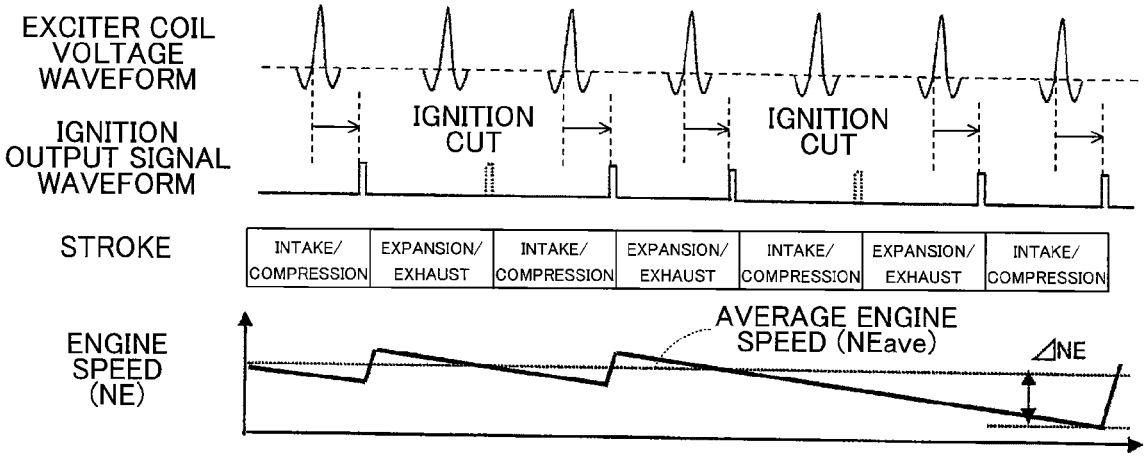

FIGS. 4A and 4B are a set of explanatory views for explaining the process.

FIG. 4A is an explanatory view of an idling condition after the engine 10 is started. The normal ignition near the end of the compression stroke and the waste ignition near the end of the exhaust stroke are conducted based on voltage waveforms of the exciter coil 48 produced at every rotation of the crankshaft 32.

FIG. 4B is an explanatory view of speed variation in the case where the ignition cut is conducted. As illustrated, when the ignition based on a voltage waveform generated in the exhaust stroke is cut, the engine speed after the ignition cut does not vary or fluctuate very much, while, when the ignition based on a voltage waveform generated in the compression stroke is cut, the engine speed after the ignition cut greatly varies or fluctuates.

Thus, it is possible to discriminate between the ignition signals by referring to the engine speed variation.

Accordingly the predetermined value of S114 is appropriately set to a value enabling to determine whether the engine speed greatly varies or not.

Returning to the explanation of FIG. 3, when the difference ΔNE exceeds the predetermined value (i.e., the result in S114 is affirmative), it is determined that the ignition based on the ignition signal produced in the compression stroke was cut and in S116, it is discriminated that this ignition signal associated with the ignition cut is on the normal ignition side.

On the other hand, when the difference ΔNE does not exceed the predetermined value (i.e., the result in S114 is negative), it is determined that the ignition based on the ignition signal produced in the exhaust stroke was cut and in S118, it is discriminated that this ignition signal is on the waste ignition side.

The program then proceeds to S120, in which it is determined whether the processing of S102 to S118 is to be repeated. The processing of S102 to S118 is repeated to increase the accuracy of the ignition signal discrimination and the result of S120 in the first program loop is set to return to S102.

When the processing of S102 to S118 is repeated, the ignition cut is conducted based on not any of the ignition signals but the ignition signal on the same side as that associated with the ignition cut in S108 of the preceding program loop. Specifically, in the case where the ignition cut was previously conducted in response to the ignition signal on the normal ignition side, the ignition is cut based on the ignition signal on the normal ignition side again in the present program loop. Similarly, in the case where the ignition cut was previously conducted in response to the ignition signal on the waste ignition side, the ignition is cut based on the ignition signal on the waste ignition side again in the present program loop.

The discrimination of S120 in the ensuing program loops whether the above processing is to be repeated is made by checking as to whether ignition signal discrimination results obtained by the repetition of the processing of S102 to S118 are substantially the same. When the multiple results are not substantially the same, the result in S120 becomes affirmative and the program returns to S102. In contrast, when the results are substantially the same, the program of this subroutine flowchart is terminated.

The explanation of FIG. 2 is resumed. The program proceeds to S12, in which the ignition control is conducted. Specifically, it is conducted by selecting the ignition signal determined to have been produced in the compression stroke, i.e., to be associated with the normal ignition in the two ignition signals produced at every crankshaft rotation, and transmitting the ignition command to the ignition coil based on the selected ignition signal.

As stated above, it is discriminated whether the ignition signal is produced in the compression stroke or exhaust stroke by comparing the average engine speed NEave over the predetermined period of time with the after-ignition-cut engine speed NEmf detected after the ignition was cut, and the ignition is controlled based on the ignition signal produced in the compression stroke in the two ignition signals. In other words, it is configured to make a discrimination on the ignition signals produced at every crankshaft rotation as to whether the produced ignition signal was produced in the compression stroke or exhaust stroke without newly adding a mechanical structure such that the ignition is controlled based on the ignition signal produced in the compression stroke. Therefore, it becomes possible to improve the duration life of the ignition plug, while making the structure of the apparatus simple and compact.

Further, the speed variation difference ΔNE between the after-ignition-cut engine speed NEmf detected after the ignition was cut and the average engine speed NEave is compared with the predetermined value, and the ignition signal is discriminated to be that produced in the compression stroke when the difference ΔNE exceeds the predetermined value, while discriminating that the ignition signal is that produced in the exhaust stroke when the difference ΔNE does not exceed the predetermined value. With this, it becomes possible to accurately and simply discriminate the ignition signal through comparison.

Further, since the comparison is repeated plural times to determine whether the ignition signal was produced in the compression stroke or exhaust stroke, it becomes possible to discriminate the ignition signal more accurately.

As stated above, the embodiment is configured to have an apparatus for and a method of controlling ignition of a general-purpose internal combustion engine (10) in which an ignition signal is produced in a compression stroke and in an exhaust stroke of a four stroke cycle, characterized in that: an engine speed detector (44, ECU 84, S10, S100) that detects a speed of the engine (NE); an average engine speed calculator (ECU 84, S10, S104) that calculates an average engine speed (NEave) over a predetermine period of time based on the detected engine speed; an ignition cutter (ECU 84, S10, S108) that cuts one of the ignitions to be conducted based on the produced two ignition signals; an after-ignition-cut engine speed detector (ECU 84, S10, S110) that detects an after-ignition-cut engine speed (NEmf) after the ignition was cut; an ignition signal discriminator (ECU 84, S10, S112-S120) that discriminates whether each of the two ignition signals was produced in the compression stroke or in the exhaust stroke based on the calculated average engine speed and the after-ignition-cut engine speed; and an ignition controller (ECU 84, S12) that controls the ignition based on the ignition signal discriminated to be produced in the compression stroke in the two ignition signals.

In the apparatus and method, the ignition signal discriminator compares a difference (ΔNE) between the after-ignition-cut engine speed (NEmf) and the average engine speed (NEave) with a predetermined value and discriminates it is the ignition signal produced in the compression stroke when the difference exceeds the predetermined value (S112-S118).

In the apparatus and method, the ignition signal discriminator discriminates it is the ignition signal produced in the compression stroke when the difference (ΔNE) exceeds the predetermined value each time the comparison is made (S114, S116, S120).

In the apparatus and method, the ignition signal discriminator discriminates it is the ignition signal produced in the compression stroke when the engine is idling (S102).

It should be noted that, although the above embodiment is explained with respect to the single-cylinder engine, a multi-cylinder engine can be applied instead.

Japanese Patent Application No. 2009-101624, filed on Apr. 20, 2009, is incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for controlling ignition of a general-purpose internal combustion engine in which an ignition signal is produced in a compression stroke and in an exhaust stroke of a four stroke cycle, comprising:

an engine speed detector that detects a speed of the engine;

an engine idling determiner that determines whether the engine is idling based on the detected engine speed;

an average engine speed calculator that calculates an average engine speed over a predetermine period of time based on the detected engine speed;

an ignition cutter that cuts one of the ignitions to be conducted based on the produced two ignition signals when the engine is determined to be idling;

an after-ignition-cut engine speed detector that detects an after-ignition-cut engine speed after the ignition was cut;

an ignition signal discriminator that discriminates whether each of the two ignition signals was produced in the compression stroke or in the exhaust stroke based on the calculated average engine speed and the after-ignition-cut engine speed; and an ignition controller that controls the ignition based on the ignition signal discriminated to be produced in the compression stroke in the two ignition signals.

2. The apparatus according to claim 1, wherein the ignition signal discriminator compares a difference between the after-ignition-cut engine speed and the average engine speed with a predetermined value and discriminates it is the ignition signal produced in the compression stroke when the difference exceeds the predetermined value.

3. The apparatus according to claim 2, wherein the ignition signal discriminator discriminates it is the ignition signal produced in the compression stroke when the difference exceeds the predetermined value each time the comparison is made.

4. The apparatus according to claim 1, wherein the ignition signal discriminator discriminates it is the ignition signal produced in the compression stroke when the engine is determined to be idling.

5. A method of controlling ignition of a general-purpose internal combustion engine in which an ignition signal is produced in a compression stroke and in an exhaust stroke of a four stroke cycle, comprising the steps of:

detecting a speed of the engine;

determining whether the engine is idling based on the detected engine speed;

calculating an average engine speed over a predetermine period of time based on the detected engine speed;

cutting one of the ignitions to be conducted based on the produced two ignition signals when the engine is determined to be idling;

detecting an after-ignition-cut engine speed after the ignition was cut;

discriminating whether each of the two ignition signals was produced in the compression stroke or in the exhaust stroke based on the calculated average engine speed and the after-ignition-cut engine speed; and controlling the ignition based on the ignition signal discriminated to be produced in the compression stroke in the two ignition signals.

6. The method according to claim 5, wherein step of the ignition signal discrimination compares a difference between the after-ignition-cut engine speed and the average engine speed with a predetermined value and discriminates it is the ignition 25 signal produced in the compression stroke when the difference exceeds the predetermined value.

7. The method according to claim 6, wherein the step of ignition signal discrimination discriminates it is the ignition signal produced in the compression stroke when the difference exceeds the predetermined value each time the comparison is made.

8. The method according to claim 5, wherein the step of ignition signal discrimination discriminates it is the ignition signal produced in the compression stroke when the engine is determined to be idling.

* * * * *

UNITED STATES PATENT AND TRADEMARK OFFICE

CERTIFICATE OF CORRECTION

PATENT NO. : 8,731,805 B2
APPLICATION NO. : 12/722991
DATED : May 20, 2014
INVENTOR(S) : Keiichiro Bungo It is certified that error appears in the above-identified patent and that said Letters Patent is hereby corrected as shown below:

In the Claims

Line 29 of Column 8
Change

"ignition 25 signal"

To Be

-- ignition signal --

Signed and Sealed this
Twenty-third Day of September, 2014

Michelle K. Lee

Michelle K. Lee
*Deputy Director of the United States Patent and Trademark Office*